United States Patent [19]

Sasaya et al.

[11] 3,967,079

[45] June 29, 1976

[54] COLLISION DETECTION DEVICE

[75] Inventors: Hideaki Sasaya; Akihiro Kobayashi, both of Aichi, Japan

[73] Assignee: Nippon Soken, Inc., Nishio, Japan

[22] Filed: Jan. 3, 1975

[21] Appl. No.: 538,330

[30] Foreign Application Priority Data

Feb. 26, 1974 Japan ..... 49-23177

[52] U.S. Cl. ..... 200/61.45 R; 200/61.45 M; 200/61.53; 200/276

[51] Int. Cl.[2] ..... H01H 35/14; H01H 1/06

[58] Field of Search ..... 200/61.45 R, 61.45 M, 200/61.53, 61.76, 276

[56] References Cited

UNITED STATES PATENTS

| | | | |
|---|---|---|---|
| 2,637,791 | 5/1953 | Bleier | 200/61.53 |
| 2,921,999 | 1/1960 | Ziegler, Jr. | 200/61.53 X |
| 3,172,974 | 3/1965 | Perrino | 200/243 X |
| 3,623,449 | 11/1971 | Knutson | 200/61.53 X |
| 3,674,951 | 7/1972 | Haruna et al. | 200/61.53 |
| 3,723,681 | 3/1973 | Haruna et al. | 200/61.53 |
| 3,778,572 | 12/1973 | Matsui et al. | 200/61.45 M |
| 3,792,219 | 2/1974 | Rowley | 200/276 X |

*Primary Examiner*—James R. Scott
*Attorney, Agent, or Firm*—Cushman, Darby & Cushman

[57] ABSTRACT

A collision detection device in which a column-shaped member with a contact spring is solely permitted to be moved only in the predetermined direction regardless of the direction of the deflection of a mass and usually holding the mass on one end thereof. The contact spring serves as a connector between two fixed contacts.

3 Claims, 6 Drawing Figures

COLLISION DETECTION DEVICE

BACKGROUND OF THE INVENTION

The present invention relates to generally a collision detection device used for actuating a safety device for protecting a driver and passengers of an automobile vehicle in case of a collision, and more particularly a collision detection device which is actuated under an acceleration or deceleration only in a predetermined angle including the direction of the movement of the vehicle.

In the prior art collision detection devices, the deflection of a mass or weight for closing or opening the contacts under an acceleration or deceleration which a vehicle undergoes in case of a collision is limited to one direction so that there is a fear that the collision detection device is not actuated unless the direction of a collision coincides with the direction of the deflection of the mass or weight. In the United States it is required to protect the driver and passengers against the collision within ±30° relative to the direction of the movement of the vehicle so that there have been devised and demonstrated the collision detection devices in which the mass or weight can be deflected within a predetermined angle including the direction of the movement of the vehicle. In the collision detection devices of the type described, a plurality of contacts are disposed and spaced apart by the same distance from the rest position of the mass or weight within an angle through which is permitted the deflection of the mass or weight. However, in case of a collision, a vehicle undergoes not only the acceleration or deceleration in the direction of the collision but also the acceleration or deceleration in the lateral direction. Consequently, the mass or weight is deflected not in the direction of the collision but in the direction or sense of the composed acceleration at a speed in proportion to the magnitude of the composed acceleration. Therefore when the spacing between the contacts and the mass is short as with the case of the collision detection device for a compact car, the time period during which the mass or weight is kept in contact with the contact is short. That is, the actuation level is low. As a result, the safety device is actuated even in case of such a small accident as not to require to actuate the safety device.

In view of the above, the present invention has for its object to provide a collision detection device in which a contact spring which is interposed between two electrically isolated fixed contacts for closing them in case of an accident or collision is permitted to be deflected only in one direction regardless of the direction of the deflection of the mass or weight so that the level at which a collision is detected may be stabilized.

DESCRIPTION OF THE PREFERRED EMBODIMENTS

First Embodiment, FIGS. 1, 2, 3 and 6

Figure 1:
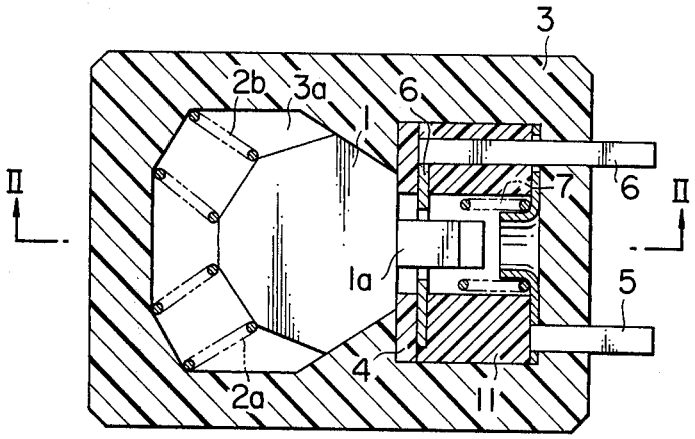
FIG. 1 is a horizontal sectional view of a first embodiment of the present invention.
Figure 2:
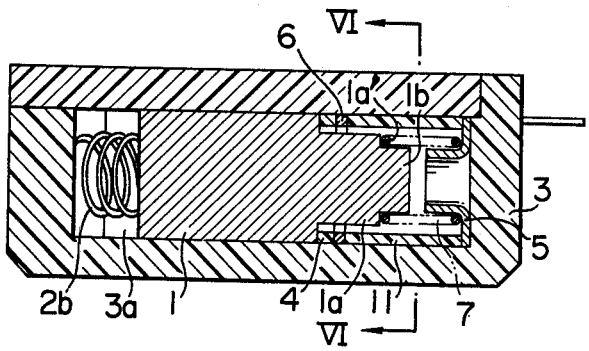
FIG. 2 is a sectional view taken along the line II—II of FIG. 1.
Figure 6:
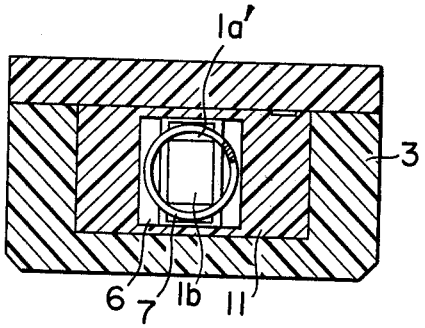
FIG. 6 is a sectional view taken along the line VI — VI of FIG. 2.

Referring to FIGS. 1 and 2 and 6 a mass or weight 1, which is deflected under acceleration, is normally pressed against an insulating seat 4 disposed within a casing 3 with a predetermined setting force by restraining springs 2*a* and 2*b*. The mass or weight 1 is movably disposed within a recess 3*a* formed within the casing 3 in such a way that the mass or weight 1 can be deflected only within a predetermined direction. An electrically conductive contact spring 7 which is a coil spring of a standard type with uniform diameter, is interposed between a first fixed contact 6 and a second fixed contact 5 both of which are disposed within the casing. The contact spring 7 is placed within a case guide 11 so that the expansion or compression of the contact spring 7 can be permitted only in one direction. A projection 1*a* is formed integral with the mass or weight 1. The projection 1*a* is made in the form of a pillar having a rectangular cross sectional configuration, the length of one side of which is larger than the diameter of the contact spring 7 and the length of the other side of which is smaller than the same. A sub projection 1*b* is formed integral with the projection 1*a* to form a stepped portion 1*a*′ at one end of the projection 1*a*. The sub projection is also in the form of a pillar having a rectangular cross sectional configuration. The length of one side of the sub projection 1*b* is smaller than that of the corresponding side of the projection 1*a*, while the length of the other side of the sub projection 1*b* is equal to that of the corresponding side of the same, and the length of the diagonal of the sub projection 1*b* is smaller than the diameter of the contact spring 7. The projection 1*a* extends through the first fixed contact 6 and presses the contact spring 7 at the stepped portion thereof so that the latter can be brought into contact with the second fixed contact 5. The stepped portion 1*a*′ is normally brought into contact with a portion of one end of the contact spring 7, while the remaining portion of the same end of the contact spring 7 is not in contact with the stepped portion 1*a*′. This remaining portion of the contact spring 7 can be brought into contact with the first fixed contact 6 when the mass or weight 1, and therefore the projection 1*a*, is deflected. The sub projection 1*b* is inserted into one end of the contact spring 7 to prevent the contact spring 7 from moving away from the projection 1*a*. The reason why the projection 1*a* is in the form of a column with a rectangular cross sectional configuration is that its stepped portion 1*a*′ receives a portion of one end of the contact spring 7 as best shown in FIG. 2 and the remaining portion of the same end of the contact spring 7 will contact with the first fixed contact 6 when the mass or weight 1 is deflected. The space is provided between the projection 1*a*, the first fixed contact 6 and the seat 4 so that the deflection of the projection 1*a* is permitted. The collision detection device with the above construction is attached on a vehicle (not shown) in such a way that the axis of the contact spring 7 coincides with the direction of the movement of the vehicle. The first fixed contact 6 and the second fixed contact 5 are electrically connected to a power source and a safety device in the manner well known in the art.

Figure 3:
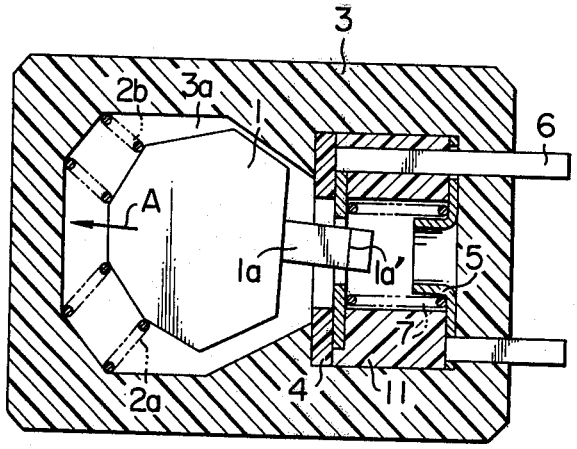
FIG. 3 is a sectional view thereof used for the explanation of the mode of operation.

Next referring particularly to FIG. 3, the mode of operation of the first embodiment will be described.

Under a greater acceleration or deceleration, the mass or weight 1 is caused to be deflected in the direction indicated by the arrow A against the springs 2*a* and 2*b* so that the contact spring 7 is deflected within the case guide 11 while keeping contact with the projection 1*a*, so as to contact with the first fixed contact 6. Therefore the first contact 6 is electrically connected through the contact spring 7 with the second fixed contact 5 so that the safety device is actuated. Even when the mass or weight 1 is deflected within the recess 3*a* at random under an acceleration in a direction other than the direction of the collision, the direction of the deflection of the contact spring 7 is kept unchanged so that the actuation level at which the first contact 6 is made into electrical contact with the second fixed contact 5 through the contact spring 7 may be stabilized.

Figure 4:
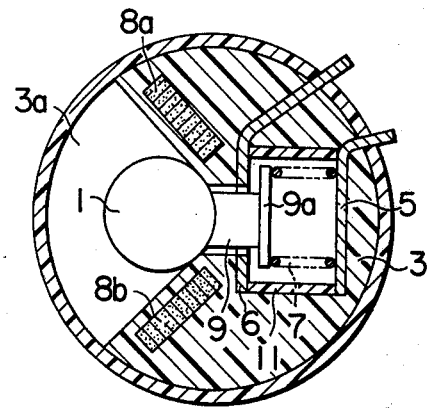
FIG. 4 is a horizontal sectional view of a second embodiment.
Figure 5:
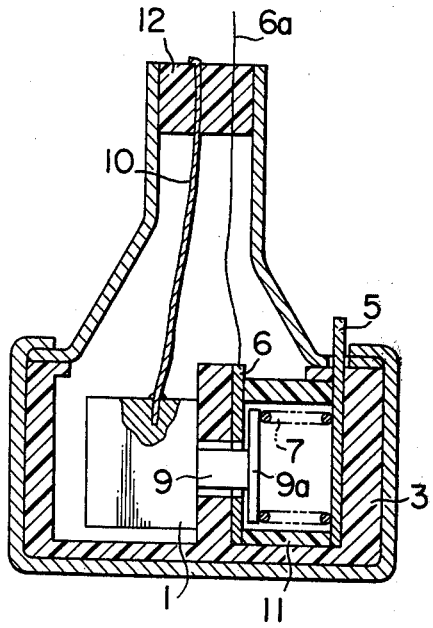
FIG. 5 is a vertical sectional view of a third embodiment.

Second and Third Embodiments, FIGS. 4 and 5

In the second embodiment shown in FIG. 4, the mass or weight 1 made of a magnetic material is kept in stationary position by magnets 8*a* and 8*b*. A column-shaped member 9 formed integral with an electrically conductive stopper 9*a* presses the contact spring 6 so that the first fixed contact 7 is normally separated from the second fixed contact 5. It should be noted that the column-shaped member 9 is not integral with the mass or weight 1.

In the third embodiment shown in FIG. 5, the mass or weight 1 is pressed against the contact spring 7 under the force of a spring member 10 such as a leaf spring so that the first fixed contact 6 is normally separated from the second fixed contact 5. The spring member 10 is embedded in an insulative plug 12 at one end thereof, while the other end thereof is fixed to the mass or weight 1. A lead wire 6*a* connected to the first fixed contact 6 extends to the outside through the insulative plug 12.

In both the second and third embodiments, the mass or weight 1 may be permitted to be deflected within a predetermined angle relative to the direction of the movement of the vehicle. The second and third embodiments are substantially similar in construction to the first embodiment except those arrangements described above.

Next the mode of operation of the second and third embodiments will be described. Under a great acceleration produced when the vehicle collides against another vehicle or the like, the mass or weight 1 is deflected in the direction of the collision or in the direction or sense of the composed acceleration vector against the attracting forces of the magnets 8*a* and 8*b* (in the second embodiment) or against the force of the leaf spring 10 (in the third embodiment). As a result, the pressing force which is exerted through the column-shaped member 9 to the contact spring is decreased. That is, the column-shaped member 9 is deflected only in the left direction in FIG. 4 or 5 so that the first fixed contact 6 is electrically connected through the contact spring 7 and the conductive stopper 9*a* with the second fixed contact 5. Thus the safety device is actuated.

In the first, second and third embodiments, the actuating level of the collision detection device may be set by adjusting the forces of the springs 2*a*, 2*b* or 10 or the magnets 8*a* and 8*b*, which are pressure means, or by adjusting the axial length of the projection 1*a* or column-shaped member, so that the collision detection device may be made insensitive to the acceleration or deceleration of a high frequency which the vehicle undergoes when the vehicle is running on a bad or rough road.

As described above, according to the present invention, the contact spring is interposed within the case guide between the first and second fixed contacts, which are electrically isolated from each other, in such a way that the contact spring may be deflected only in a predetermined direction to close or open the first and second fixed contacts regardless of the direction of the deflection of the mass or weight. Therefore, the first and second contacts are always closed at a predetermined level so that the safety device may be always actuated at a predetermined level.

What is claimed is:

1. A collision detection device comprising:

a. a casing;

b. a mass disposed within said casing in such a way that said mass is deflected under acceleration or deceleration within a predetermined angle including the direction of the movement of the vehicle;

c. pressure means for pressing said mass;

d. a first fixed contact and a second fixed contact both fixed within said casing so as to be electrically isolated from each other;

e. a contact coil spring interposed between said first and second contacts in such a way that said contact spring can be deflected only in the direction of the movement of the vehicle when said mass is deflected, said contact spring having one end portion in contact with said second fixed contact; and f. a column-shaped member fixed to said mass and extended through said first fixed contact to press said contact spring in the direction opposite to the direction of the movement of the vehicle, by the force of said pressure means, said column-shaped member having a stepped portion whose length one direction is smaller than the diameter of said contact spring, said stepped portion being normally brought into contact with a portion of another end of said contact spring so that the remaining portion of the same end of said contact spring, which is normally not in contact with said stepped portion, can be brought into contact with said first fixed contact when said mass is deflected.

2. A collision detection device as set forth in claim 1 wherein, said column-shaped member has a sub-column-shaped member forming said stepped portion, said sub-column-shaped member being inserted into said another end of said contact spring to guide said contact spring.

3. A collision detection device as set forth in claim 2 wherein, said column-shaped member has a rectangular cross sectional configuration, the length of one side of which is larger than the diameter of said contact spring and the length of the other side of which is smaller than the same.

* * * * *